United States Patent [19]

Motoki et al.

[11] 4,403,539

[45] Sep. 13, 1983

[54] ARRANGEMENT FOR CONNECTING A DIAPHRAGM WITH AN ACTUATOR ROD IN A DIAPHRAGM-OPERATED DEVICE

[75] Inventors: Kenichi Motoki, Hoya; Nobuyasu Ushiroyama, Asaka, both of Japan

[73] Assignee: Honda Giken Kogyo Kabushiki Kaisha, Tokyo, Japan

[21] Appl. No.: 261,484

[22] Filed: May 7, 1981

[30] Foreign Application Priority Data

Nov. 15, 1980 [JP] Japan ..... 55-163884[U]

[51] Int. Cl.[3] ..... F01B 19/00

[52] U.S. Cl. ..... 92/94; 92/99; 417/328

[58] Field of Search ..... 417/328, 413, 470; 92/94, 99, 101

[56] References Cited

U.S. PATENT DOCUMENTS 2,707,074 4/1955 Tussey ..... 92/99 X 3,039,399 6/1962 Everett ..... 92/99 X

FOREIGN PATENT DOCUMENTS 96784 1/1961 Netherlands ..... 92/94

*Primary Examiner*—Richard E. Gluck

*Attorney, Agent, or Firm*—Armstrong, Nikaido, Marmelstein & Kubovcik

[57] ABSTRACT

An improved arrangement for connecting a diaphragm and an actuator rod in a diaphragm-operated device, which is simple in construction and easy to assemble or disassemble. The arrangement includes a diaphragm of elastic material having a movable central portion and a connection boss formed at the movable portion. The connection boss has a blind bore in which is fitted an actuator rod for elastic engagement. A retainer is fitted over the outer periphery of the connection boss for restraining deformation of the connection boss. The retainer is urged against the diaphragm by means of a return spring which acts to resiliently urge the diaphragm in one direction.

2 Claims, 2 Drawing Figures

ARRANGEMENT FOR CONNECTING A DIAPHRAGM WITH AN ACTUATOR ROD IN A DIAPHRAGM-OPERATED DEVICE

BACKGROUND OF THE INVENTION

1. Field of the Invention

This invention relates to an arrangement for connecting a diaphragm with an actuator rod in a diaphragm-operated device such as a diaphragm-operated pump.

2. Description of the Prior Art

In the conventional diaphragm-operated devices, a diaphragm is connected with an actuator rod by means of a pair of clamping plates which serve to clamp therebetween a movable portion of the diaphragm and to which is caulked the actuator rod. In this arrangement, however, the diaphragm and the actuator rod are fixedly connected with each other to form an integral unit which is difficult to disassemble, and thus in the event where one of these members need be replaced for repairment with a new one, the other normally operating one has to be simultaneously renewed with a new one, resulting in an wasteful and uneconomical situation. In addition, upon caulking the actuator rod to the clamping plates, the plating at the caulking portions of these members peels off and rusts may be thereafter formed at the peeled portions and admixed into a treating liquid.

SUMMARY OF THE INVENTION

In view of the above, the present invention aims to provide a novel and improved arrangement for connecting a diaphragm with an actuator rod in a diaphragm-operated device, which is able to avoid the above disadvantages encountered in the conventional arrangement and which is simple in construction and easy and efficient to assemble.

According to the present invention, there is provided an arrangement for connecting a diaphragm and an actuator rod in a diaphragm-operated device comprising a diaphragm formed of elastic material and having a movable central portion, a connection boss formed at the movable central portion of said diaphragm and having a blind bore, an actuator rod fitted in said blind bore for elastic engagement therewith, a retainer fitted over the outer periphery of said connection boss for restraining deformation of said connection boss, spring means for urging said retainer against said diaphragm.

The above and other objects, features and advantages of the present invention will be better understood from the following detailed description of the invention when taken in conjunction with the accompanying drawing which illustrates a presently preferred embodiment of the invention.

DESCRIPTION OF THE PREFERRED EMBODIMENT

Figure 1:
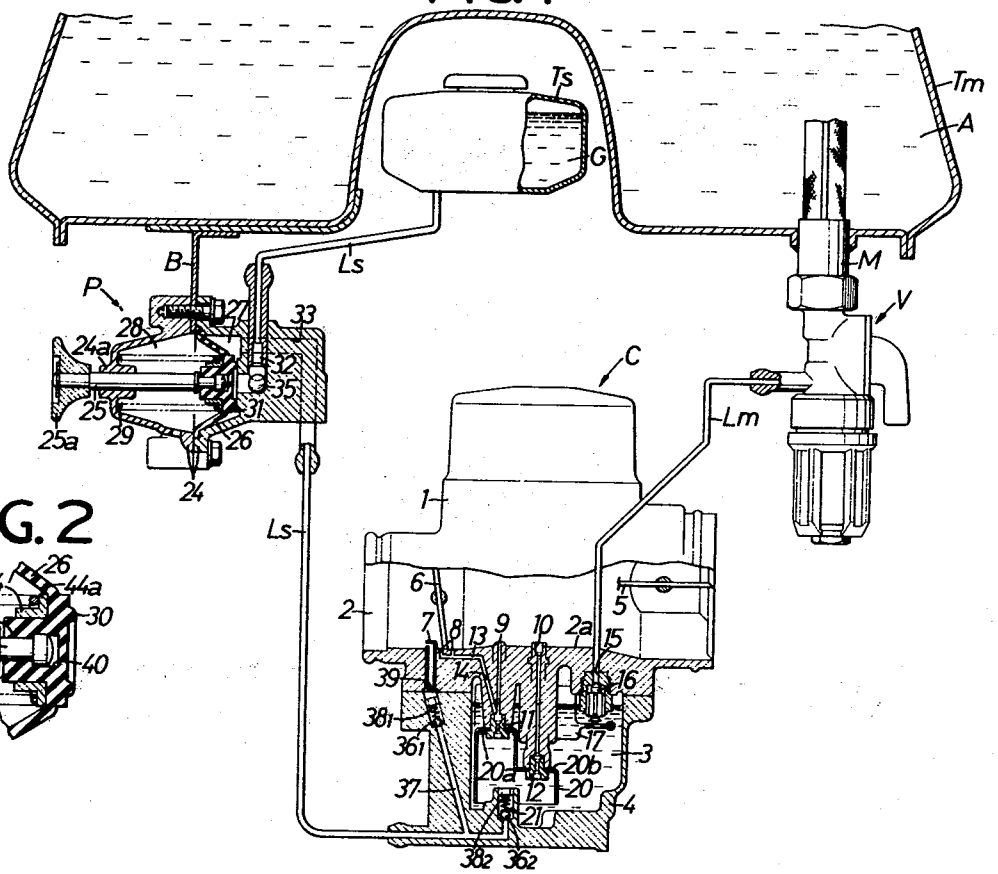
FIG. 1 is an overall view of a fuel feed system for an internal combustion engine provided with a diaphragm type fuel-metering pump which is constructed in accordance with the present invention, showing the essential portions partially cut away.
Figure 2:
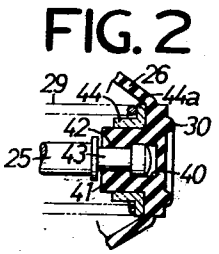
FIG. 2 is an enlarged view of a part of the pump as shown in FIG. 1, illustrating an arrangement for connecting a diaphragm with an actuator rod.

Referring to the drawings and particularly to FIG. 1, there is shown a carburetor C for an internal combustion engine which is supplied with a main fuel A such as alcohol and an auxiliary fuel G such as gasoline. The main fuel A is supplied from a main fuel tank Tm to the carburetor C via a main fuel passage Lm, which is provided at an intermediate portion thereof with a known switch cock V having three control positions, "ON," "OFF" and "RESERVE." The auxiliary fuel G is supplied from an auxiliary fuel tank Ts to the carburetor C via an auxiliary fuel passage Ls, which is provided at an intermediate portion thereof with a metering pump P of the present invention. The switch cock V and the metering pump P are fastened to opposite sides of a lower surface of the main fuel tank Tm via a support member M and a bracket B, respectively.

The construction of the carburetor C and the metering pump P will be described in detail hereinafter.

The carburetor C comprises a carburetor body 1 having an intake passage 2 extended horizontally through an central portion thereof, and a vessel 4 defining a float chamber 3 and joined to a lower portion of the intake passage 2.

The intake passage 2 having a central venturi portion **2*a* is provided therein with a choke valve 5 on the upstream side (right-hand side in the drawing) of the venturi portion 2*a*, and a throttle valve 6 on the downstream side thereof. A starting nozzle 7, a by-pass port 8, a primary nozzle 9, and a secondary nozzle 10 are opened into such positions in the intake passage 2 that are slightly downstream of the throttle valve 6, in the vicinity of the throttle valve 6, halfway between the throttle valve 6 and the venturi portion 2*a*, and in the venturi portion 2*a*, respectively. The primary nozzle 9 and the secondary nozzle 10 are communicated with the float chamber 3 via a primary jet 11 and a secondary jet 12, respectively. A low-speed fuel passage 13 is branched from a passage communicating the primary nozzle 9 and primary jet 11 with each other. The low-speed fuel passage 13 is communicated with the by-pass port 8. A slow jet 14 is inserted into the low-speed fuel passage 13**.

A main fuel supply port 15 is opened into the lower surface of an upper wall of the float chamber 3, and a known float valve 16 is provided at the main fuel supply port 15. The float valve 16 is adapted to cooperate with a float 17 provided in the float chamber 3, to open and close the main fuel supply port 15 so that the level of a fuel oil in the float chamber 3 can be kept constant. The main fuel passage Lm referred to above is communicated with the main fuel supply port 15.

In the float chamber 3, a cup body 20 having an opening at its lower end is secured to the primary and secondary jets 11, 12, which are screwed to the lowermost portion of the carburetor body 1. The cup body 20 has a two-step horizontal wall having an upper wall portion **20*a* and a lower wall portion 20*b*. The primary jet 11 is opened at the inner surface of the upper wall portion 20*a*, and the secondary jet 12 at the inner surface of the lower wall portion 20*b***.

An auxiliary fuel supply port 21, which is opened into the cup body 20, is provided in a bottom wall of the vessel 4. The auxiliary fuel passage Ls is communicated with the auxiliary fuel supply port 21.

A starting fuel passage 37 is branched from that portion of the auxiliary fuel passage Ls which is located very closely to the auxiliary fuel supply port 21. The starting fuel passage 37 is communicated with the starting nozzle 7 referred to above.

The metering pump P comprises a pump body 24 having a diaphragm 26 by which the interior of the pump body 24 is divided into a pump chamber 27 and an atmospheric chamber 28, an actuator rod connected to the diaphragm 26, and a return spring 29 provided in the atmospheric chamber so as to urge the diaphragm 26 toward the pump chamber 27. The actuator rod 25 is slidably supported through a boss 24*a* formed on the right end wall of the pump body 24, and a traction stroke of the actuator rod 25 is restricted by the boss 24*a*.

According to the present invention, the diaphragm 26 and actuator rod 25 are connected together in the following manner.

The diaphragm 26 consists of an elastic material, such as rubber. A connecting boss 41 having a blind bore 40 is formed integrally on that side surface of the central movable portion of the diaphragm 26 which faces the atmospheric chamber 28, and an annular seal bead 30 is also formed integrally on the other side surface of the diaphragm 26. An annular projection 42 is formed at an open end of the blind bore 40.

The actuator rod 25 is formed in such a manner that an inner end portion thereof can be engaged with the blind bore 40. The actuator rod 25 has in its outer circumferential surface an annular recess 43 which can be engaged with the annular projection 42 referred to above. Accordingly, when the inner end portion of the actuator rod 25 is fitted into the blind bore 40 as the connecting boss 41 is widened thereby, the recess 43 and projection 42 come into engagement with each other, so that the connecting boss 41 and actuator rod 25 are engaged with each other elastically in a locked manner. In order to maintain such locked type engagement, a cylindrical retainer 44 is fitted around the outer circumferential surface of the connecting boss 41. The retainer 44 serves to prevent the connecting boss 41 from being deformed, and also the recess 43 and projection 42 from being disengaged from each other. Thus, the actuator rod 25 can be prevented from coming out of the blind bore 40. The retainer 44 has a flange 44*a* contacting the diaphragm 26. The return spring 29 referred to above is provided between the flange 44*a* and a side surface opposed thereto of the right end wall of the atmospheric chamber 28. Accordingly, the retainer 44 is in press contact with the diaphragm 26 owing to the resilient force of the spring 29.

The actuator rod 25 is provided with a knob 25*a* at an outer end thereof. A left end wall of the pump chamber 27 is provided with a valve seat 31 which is adapted to cooperate with the seal bead 30 formed on the diaphragm 26. An inlet port 32 and an outlet port 33 extending as they sandwich the valve seat 31 therebetween are opened into the pump chamber 27. The pump chamber 27 is communicated with an upstream side portion of the auxiliary fuel passage Ls via the inlet port 32, and with a downstream side portion thereof via the outlet port 33.

A suction valve 35, a first discharge valve $36_1$ and a second discharge valve $36_2$, which belong to the measuring pump P, are provided in the inlet port 32, starting fuel passage 37 and auxiliary fuel supply port 21, respectively. A set load of a valve spring $38_1$ for the first discharge valve $36_1$ is lower than that of a valve spring $38_2$ for the second discharge valve $36_2$, so that a valve opening pressure for the first discharge valve $36_1$ is lower than that for the second discharge valve $36_2$. An orifice 39 is formed in the starting nozzle 7 for the purpose of applying a predetermined valve opening pressure to the second discharge valve $36_2$ after the first discharge valve $36_1$ has been opened. An ejection port of the starting nozzle 7 may be narrowed so as to use the starting nozzle 7 instead of the orifice 39. The suction valve 35 referred to above consists of a normally-opened valve.

The operation of the above embodiment will now be described.

In order to start the engine at a low temperature, the switch cock V is separated to open the main fuel passage Lm to introduce the alcohol fuel A from the main fuel tank Tm into the float chamber 3 until a predetermined level has been attained.

When the actuator rod 25 in the metering pump P is then drawn outwardly, the seal bead 30 is removed from the valve seat 31. As a result, the inlet port 32 is opened, and the pressure in the pump chamber 27 is reduced due to the rightward movement of the diaphragm 26. This allows the gasoline fuel G in the auxiliary fuel tank Ts to be sucked into the pump chamber 27 through the inlet port 32. When the actuator rod 25 is then released, the diaphragm 26 is moved to left by the resilient force of the return spring 29 to increase the pressure in the pump chamber 27. In accordance with an increase in the pressure in the pump chamber 27, the suction valve 35 is closed as shown in chain line, and the first discharge valve $36_1$, which is adapted to be opened at a low pressure, is then opened. The second discharge valve $36_2$, which is adapted to be opened at a high pressure, is thereafter opened. Accordingly, the gasoline fuel G in the pump chamber 27 is ejected via the starting fuel passage 37 initially from the starting nozzle 7 into the intake passage 2, and then from the auxiliary fuel supply port 21 into the cup body 20. When the actuator rod 25 has reached the left limit with the seal bead 30 brought into contact with the valve seat 31 to close the inlet port 32, the operation of the pump P is stopped.

In the cup body 20, a part of the alcohol fuel A occupying the interior thereof is then forced out from the opening at the lower end of the cup body 20 due to the ejection pressure of the gasoline fuel G and the difference between the specific gravities of the fuels A, G, so that the oil level in the float chamber 3 exceeds a predetermined level. As a result, comparatively pure gasoline fuel G is concentrated in the uppermost portion of the interior of the cup body 20 and the concentration of the gasoline fuel G in the alcohol fuel A is decreased toward the lower end of the cup body 20.

When the choke valve 5 is then closed and the throttle valve 6 opened at a suitable opening degree for first idling, to turn a crankshaft in the engine, the gasoline fuel G, which has already been ejected from the starting nozzle 7, is drawn by the suction vacuum in the engine to be supplied thereinto. As a result, an initial explosion immediately occurs in the engine, and the suction vacuum increasing due to the explosion works greatly on the by-pass port 8 and primary nozzle 9. Consequently, the fuel consisting mainly of gasoline fuel G is sucked from the primary jet 11, which is communicated with the by-pass port 8 and primary nozzle 9, since the primary jet 11 is opened at the highest portion of the cup body 20, where the gasoline fuel G is most concentrated. The fuel thus sucked from the primary jet 11 is ejected from the port 8 and nozzle 9 to be supplied to the engine. Thus, the engine is completely exploded, so that an engine-starting operation is completed.

When the throttle valve 6 is opened soon after the engine has been started, to apply a load thereto, the suction vacuum in the engine working on the primary nozzle 9 works gradually on the secondary nozzle 10 in accordance with an increase in the opening degree of the throttle valve 6. As a result, the fuel consisting mainly of gasoline fuel G is ejected from the primary nozzle 9 as mentioned above, and a mixed fuel of gasoline and alcohol is ejected from the secondary nozzle 10 via the secondary jet 12 since the secondary jet 12, which is communicated with the secondary nozzle, is opened at an intermediate portion of the interior of the cup body 20, where a gasoline-alcohol mixture prevails. After the throttle valve 6 has been opened, the composition of fuel supplied to the engine is thus varied gradually, so that shifting of the engine operation from a non-load operation to a load operation can be carried out smoothly even when little time has passed after the starting of the engine.

When the fuel in the cup body 20 has been consumed, the alcohol fuel A in the float chamber 3 is moved thereinto from the underside thereof to dilute the gasoline fuel G. Finally, the alcohol fuel A alone occupies the interior of the cup body 20, so that the engine A comes to be operated with the normally-used alcohol fuel A.

If a traction stroke of the actuator rod 25 in the metering pump P is adjusted in accordance with the degree of coldness in a place where the engine is started, the rate of ejection of the gasoline fuel G into the cup body 20 can be set to a suitable level. When the engine is started in a warm place, the ejection of gasoline fuel G is not necessary.

In order to discharge the content of the auxiliary fuel tank Ts therefrom for cleaning the interior thereof, the downstream end of the auxiliary fuel passage Ls is disconnected, and the actuator rod 25 is pulled to hold the valve body 30 in an opened state, so that the content of the tank Ts flows out of the passage Ls via the normally-opened suction valve 35, inlet port 32, pump chamber 27 and outlet port 33. Since the suction valve 35 consists of a normally-opened type valve, a pumping operation of the actuator rod is not necessary.

Since the switch cock V and metering pump P in the fuel feed system according to the present invention are disposed at both sides of the lower surface of the main fuel tank Tm as mentioned above, the dead space under the main fuel tank Tm can be utilized effectively, and neither the switch cock V nor the metering pump P obstructs a rider on the motorcycle. Moreover, the rider on the motorcycle easily reaches the switch cock V and metering pump P as he sits on the seat, to operate the same without difficulties. Therefore, the switch cock and metering pump P are not erroneously operated.

The metering pump P is a diaphragm type pump. The diaphragm 26 of an elastic material in the metering pump P is integrally formed at its central movable portion with a connecting boss 41 having a blind bore 40 therein. The actuator rod 25 is inserted at its one end into the connecting boss 41, and the boss 41 and rod 25 are connected together in such a manner that the projection formed on the inner circumferential surface of the former and the recess formed in the outer circumferential surface of the latter are elastically engaged with each other. The retainer 44 is fitted around the outer circumferential surface of the connecting boss 41 to prevent the boss 41 from being deformed. The retainer 44 is kept urged against the diaphragm 26 by the spring 29. Therefore, the diaphragm 26 and actuator rod 25 can be securely joined together by merely setting the retainer 44 and spring 29 in the above-mentioned manner, so that a troublesome caulking step, which has been used in the prior art for joining diaphragm and actuator rod together, is not required. In fact, the measuring pump used in the present invention can be assembled conveniently. Conversely, the diaphragm 26 and actuator rod 25 can be separated from each other by only removing the retainer 44 and spring 29. Therefore, even one of the diaphragm and actuator rod can be renewed for repairing the old one which has just removed.

Since the diaphragm 26 and actuator rod 25 can be joined together without using such a caulking or any other step that may cause scratches on the surface of the actuator rod 25, the plating on the surface of the actuator 25 does not come off, so that rust is not formed thereon. Even if rust should be formed on the surface of the actuator rod 25, the rust does not extend to a diaphragm chamber, which is on the opposite side of the actuator rod 25 with respect to the diaphragm 26, since the actuator rod 25 is held at its inner end in the blind bore 40 as mentioned above, and not passed through the diaphragm 26. Accordingly, it is desirable that the diaphragm chamber referred to above be used as a fluid treating chamber like the pump chamber 27 of the above-described embodiment.

If the return spring for the diaphragm 26 is utilized also as the spring 29 referred to in the above paragraph, the return spring comes to perform a double service. In addition, the retainer 44 serves also as a seat for the return spring 29. This allows the number of parts of the measuring pump to be reduced to a great extent, and the construction of the pump to be simplified. In other words, the assembling efficiency of the measuring pump can be much improved.

The present invention is not, of course, limited to the above embodiment; it may be modified in various ways within the scope of the appended claims.

What is claimed is:

1. An arrangement for connecting a diaphragm and an actuator rod in a diaphragm-operated device comprising a diaphragm formed of elastic material and having a moveable central portion, a connection boss formed at the moveable central portion of said diaphragm and having a blind bore and an annular projection extending radially inwardly from the inner periphery of said blind bore, an actuator rod fitted in said blind bore for elastic engagement therewith having one end portion extending into said blind bore, said one end portion having an annular recess receiving the inwardly extending projection, a retainer fitted over the outer periphery of said connection boss for restraining deformation of said connection boss, said retainer including a cylinder portion fitted over the outer periphery of of the connection boss for restraining radially expansive deformation of the boss and a flange portion integrally extending from the cylinder portion in a radially outward direction with its one side surface abutting against the diaphragm, and spring means for urging said retainer against said diaphragm, the other side surface of said flange portion supporting one end of said spring means.

2. An arrangement according to claim 1, wherein said spring means comprises a return spring for resiliently urging said diaphragm in one direction.

* * * * *